US005526634A

United States Patent [19]

Mima et al.

[11] Patent Number: 5,526,634

[45] Date of Patent: Jun. 18, 1996

[54] ROBOT DEVICE FOR PILED-PACKAGE TYPE DOUBLE TWISTER

[75] Inventors: Hiroshi Mima, Joyo; Tadashi Suzuki, Uji, both of Japan

[73] Assignee: Murata Kikai Kabushiki Kaisha, Kyoto, Japan

[21] Appl. No.: 489,829

[22] Filed: Jun. 13, 1995

Related U.S. Application Data

[63] Continuation of Ser. No. 780,276, Oct. 18, 1991, abandoned.

[30] Foreign Application Priority Data

| | | | |
|---|---|---|---|
| Oct. 23, 1990 | [JP] | Japan | 2-110215 U |
| Nov. 30, 1990 | [JP] | Japan | 2-130114 U |
| Dec. 19, 1990 | [JP] | Japan | 2-400967 U |

[51] Int. Cl.[6] ..... D01H 9/00; D01H 13/26; D01H 1/10

[52] U.S. Cl. ..... 57/270; 57/279; 57/281; 57/58.520; 242/35.50 A

[58] Field of Search ..... 57/261, 266, 268, 57/269, 270, 276, 278, 279, 264, 281, 58.52, 58.83, 58.86, 304; 242/35.5 A, 36

[56] References Cited

U.S. PATENT DOCUMENTS

| | | | |
|---|---|---|---|
| 2,650,779 | 9/1953 | Uhlig | 57/58.86 |
| 4,107,910 | 8/1978 | Fürstenberg et al. | 57/304 X |
| 4,386,495 | 6/1983 | Rothmeier et al. | 57/279 |
| 4,671,054 | 6/1987 | Grundmann et al. | 57/304 |
| 4,739,611 | 4/1988 | Rohner | 57/270 X |
| 4,928,476 | 5/1990 | Otoshima et al. | 57/266 X |
| 4,998,405 | 3/1991 | Frentzel-Beyme | 57/58.52 X |
| 5,095,692 | 3/1992 | Scheufeld et al. | 57/304 |
| 5,119,621 | 6/1992 | Inger | 57/281 |
| 5,136,833 | 8/1992 | Inger | 57/58.52 X |
| 5,148,664 | 9/1992 | Suzuki | 57/269 |
| 5,182,902 | 2/1993 | Mima et al. | 57/279 |
| 5,184,453 | 2/1993 | Mima et al. | 57/268 X |
| 5,189,872 | 3/1993 | Mima et al. | 57/270 X |

*Primary Examiner*—Daniel P. Stodola
*Assistant Examiner*—Michael R. Mansen
*Attorney, Agent, or Firm*—Loeb and Loeb

[57] ABSTRACT

A robot device for a piled-package type double twister, capable of detecting the condition of a pilot lamp for indicating yarn breakage, provided in a double-twisting unit which unwinds yarns from two feed packages placed one over the other, twist the yarns, winds the twisted yarn, of starting a feed package changing operation when the take-up package has a predetermined size, of continuing the feed package changing operation if a sensor for detecting the exhaustion of the feed packages detects yarn at least on one of the two feed packages, and of returning the feed packages to their positions and terminating the feed package changing operation if both the feed packages have yarns.

7 Claims, 9 Drawing Sheets

ROBOT DEVICE FOR PILED-PACKAGE TYPE DOUBLE TWISTER

This is a continuation of application Ser. No. 07/780,276 filed on Oct. 18, 1991, now abandoned.

FIELD OF THE INVENTION

The present invention relates to a robot device for a piled-package type double twister and, more specifically, to a robot device for a piled-package type double twister capable of automatically carrying out operations for feed package changing, yarn end finding, threading, doffing and yarn fastening.

RELATED ART STATEMENT

A double twister has a plurality of twisting units arranged in a row. Each twisting unit has a spindle supporting a feed package. A yarn unwound from the feed package and threaded through the bore of the spindle is double-twisted and the double-twisted yarn is taken up on a bobbin supported on a cradle in a take-up package. When all the yarn of the feed package is taken up on the bobbin in a full take-up package and an empty bobbin is left on the spindle, a feed package changing procedure must be carried out, in which the empty bobbin is removed from the spindle and a full feed package is put on the spindle (package changing), the yarn end of the full feed package is pulled out from the full feed package (yarn end finding), the yarn is threaded through the spindle (threading), the full take-up package is removed from the cradle and an empty take-up bobbin is put on the cradle (doffing), and the leading end of the yarn unwound from the feed package is fastened to the take-up bobbin (yarn fastening).

The feed package changing procedure, however, is very troublesome. The applicant of the present application has previously proposed a robot device capable of automatically carrying out the feed package changing procedure in Japanese Patent Provisional Publication No. Hei 2-243470. This robot device travels along the row of the twisting units, stops at a position corresponding to a twisting unit indicated by lighting a pilot lamp, detects if the feed package has been exhausted, carries out the feed package changing procedure if the feed package has been exhausted or advances without carrying out the feed package changing procedure if the feed package has not been exhausted.

A double-package type double twister doubles and double-twists yarns unwound from two feed packages of the same size supported one over the other on a spindle. If the two yarns unwound from the two feed packages differ from each other in yarn tension during the doubling and double-twisting operation, it is possible that one of the two feed packages is exhausted before the other. If one of the feed packages is not exhausted, a predetermined quantity of yarn is wound on the take-up package and hence the feed package changing procedure may be carried out.

However, in applying the robot device to a double-package type double twister, it is difficult to detect the exhaustion of the feed packages supported one over the other on the spindle and hence it is impossible to carry out the feed package changing procedure efficiently.

OBJECT AND SUMMARY OF THE INVENTION

It is an object of the present invention to provide a robot device capable of readily detecting the exhaustion of two feed packages supported one over the other on a spindle and of efficiently carrying out the feed package changing procedure.

It is another object of the present invention to provide a yarn end finding device for a double-twister robot device capable of avoiding pulling out excessive yarns in finding yarn ends from feed packages.

It is still another object of the present invention to provide a robot device for a double twister capable of threading of feed packages supported on a spindle provided with a tension ball.

Other objects of the present invention will appear in the following description and appended claims, reference being had to the accompanying drawings forming a part of this specification.

To achieve the object, the present device provides a robot device for a piled-package type double twister, capable of detecting the condition of a pilot lamp for indicating yarn breakage, provided in a double-twisting unit which unwinds yarns from two feed packages placed one over the other, twist the yarns, winds the twisted yarn, of starting a feed package changing operation when the take-up package has a predetermined size, of continuing the feed package changing operation if a sensor for detecting the exhaustion of the feed packages detects yarn at least on one of the two feed packages, and of returning the feed packages to their positions and terminating the feed package changing operation if both the feed packages have yarns.

The robot device detects the lighted pilot lamp, and starts the feed package changing operation if the take-up package has a predetermined size. During the feed package changing operation, the sensor provides a signal indicating the condition of the feed packages. If the signal indicates that at least one of the feed packages has been exhausted, the feed package changing operation is continued. If the signal indicates that both the feed packages have yarns, the feed package is returned to their positions and the feed package changing operation is terminated.

The detection of the condition of the two feed packages during the feed package changing operation facilitates detecting the exhaustion of each of the two packages. Since the feed package changing operation is continued if at least one of the feed packages has been exhausted, and the feed packages are returned to their positions and the feed package changing operation is terminated if both the feed packages have yarns, the feed package changing operation can efficiently be carried out.

To achieve the another object, the present invention provides a yarn end finding device for a robot device of a double-twister, having a suction nozzle for sucking the leading ends of yarns of feed packages wound around a top cap provided on top of a tubular adapter supporting the feed packages, characterized in that the suction nozzle is provided with a sensor for detecting the yarns sucked into the suction nozzle, and a gripping device that is actuated to grip the yarns in response to a detection signal provided by the sensor upon the detection of the yarns.

To achieve the still another object the present invention provides a robot device for a double twister, having an operating arm for threading the yarns of feed packages supported on a spindle of the double twister, characterized in that the operating arm is provided with a ball holding unit for attracting a steel ball mounted on the upper end of a top cap for the feed packages during threading operation.

DESCRIPTION OF THE PREFERRED EMBODIMENT

A preferred embodiment of the present device will be described hereinafter with reference to the accompanying drawings.

Figure 1:
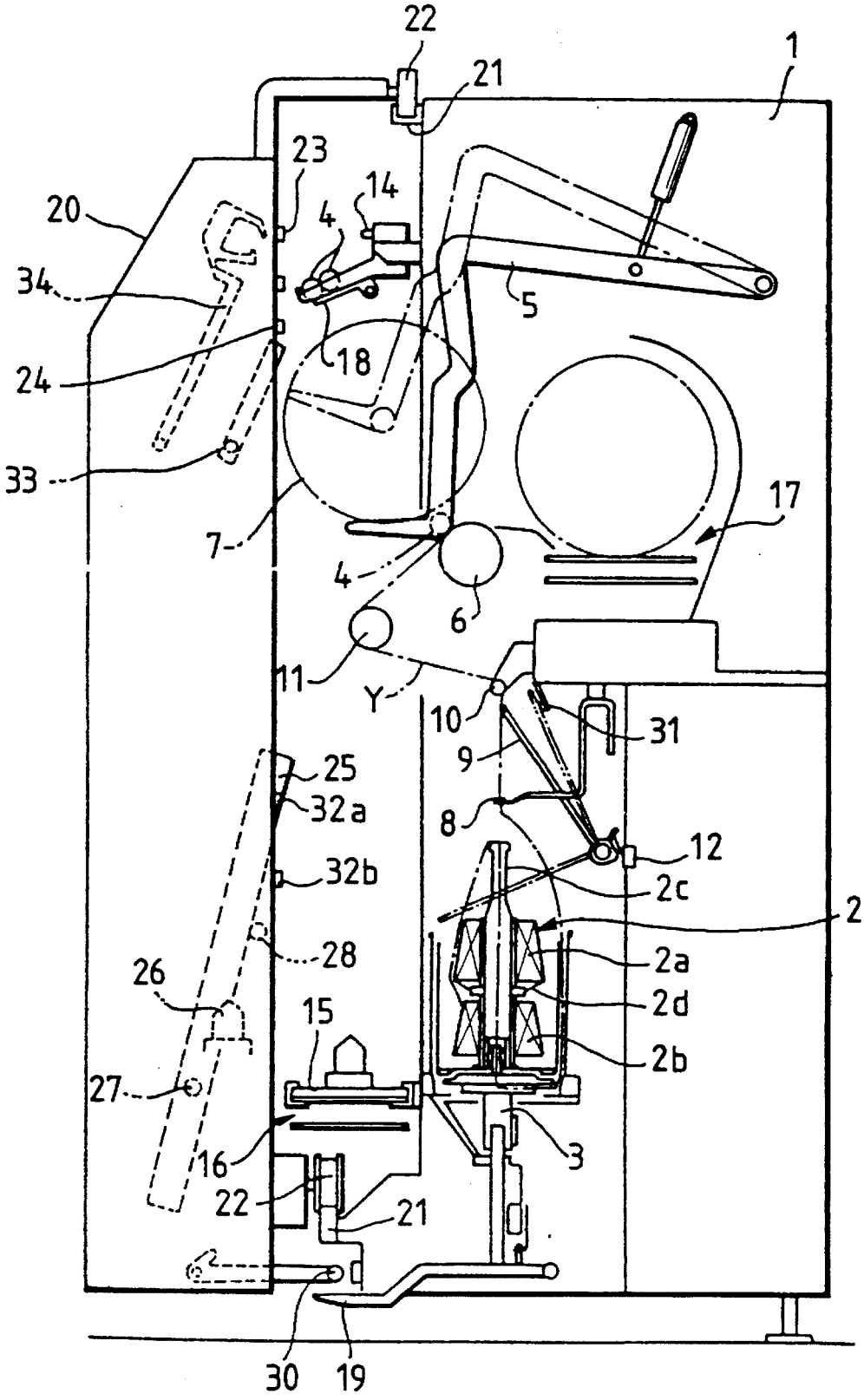
FIG. 1 is a sectional side view of a robot device in a preferred embodiment according to the present invention.

Referring to FIG. 1, indicated at 1 is one of a plurality of double-twisting units of a double twister. The double-twisting unit 1 has a spindle supporting two feed packages 2 (2*a* and 2*b*) one over the other, and a cradle 5 supporting a take-up bobbin 4 in a horizontal position. Yarns Y unwound from the feed packages 2 are threaded through the bore of the spindle 3 for double-twisting. The twisted yarn travels upward and is taken up in a take-up package 7 on the take-up bobbin 4 driven for rotation by a rotary drum 6. The two feed packages 2 are mounted one over the other on a tubular adapter 2*c* with a cuplike yarn guide 2*d* interposed therebetween to guide the yarn Y unwound from the lower feed package 2*b*. The yarn guide 2*d* is formed by bending fine resin wires.

A snail wire 8 for guiding the twisted yarn Y, a drop wire 9 for detecting yarn breakage, a yarn guide roller 10, and a feed roller 11 for delivering the twisted yarn Y to the take-up package 7 are arranged in that order above the feed packages 2. The drop wire 9 is set against the twisted yarn Y. If both the two feed packages 2 are exhausted or the twisted yarn Y is broken, the drop wire 9 drops to turn on a switch 12 disposed near the lower end thereof. Then, a cylinder actuator is actuated to raise the cradle 5 to a doffing position and a pilot lamp 14 disposed at an upper front position on the double-twisting unit 1 is turned on.

A feed package conveyor 16 for conveying sets of feed packages each of two feed packages put one over the other on a tray 15 is extended in front of the spindles 3 along the double-twisting units 1. A full package conveyor 17 for conveying full packages 7 removed from the cradles 5 is extended behind the rotary drums 6 along the double-twisting units 1. A bobbin stocker 18 is disposed at a front upper position on the double-twisting unit 1, and a plurality of take-up bobbins 4 are reserved in the bobbin stocker 18. A pedal 19 is disposed at a front lower position on the double-twisting unit 1. The spindle 3 is braked to a stop when the pedal 19 is depressed to a first position, and threading compressed air is supplied to the spindle 3 when the pedal 19 is depressed to a second position.

A robot device 20 for a feed package changing operation and the associated operations travels along the double-twisting units 1. Wheels 22 held on the robot device 20 roll along rails 21 extended along the front upper portions and the front lower portions of the double-twisting units 1.

The robot device 20 is provided at its upper portion with a sensor 23 for detecting the lighted pilot lamps 14 of the double-twisting units 1, and at a position below the sensor 23 with a sensor 24 for detecting the size of a take-up package 7 held at the doffing position. Upon the detection of the lighted pilot lamp 14, the robot device 20 stops at a position corresponding to the double-twisting unit 1 indicated by the lighted pilot lamp 14 and detects the size of the take-up package. The robot device starts the feed package changing procedure including a series of operations from a feed package changing operation to a yarn fastening operation if the take-up package 7 has a predetermined size. The robot device advances without carrying out the feed package changing procedure if the size of the take-up package 7 is smaller than the predetermined size.

Figure 2:
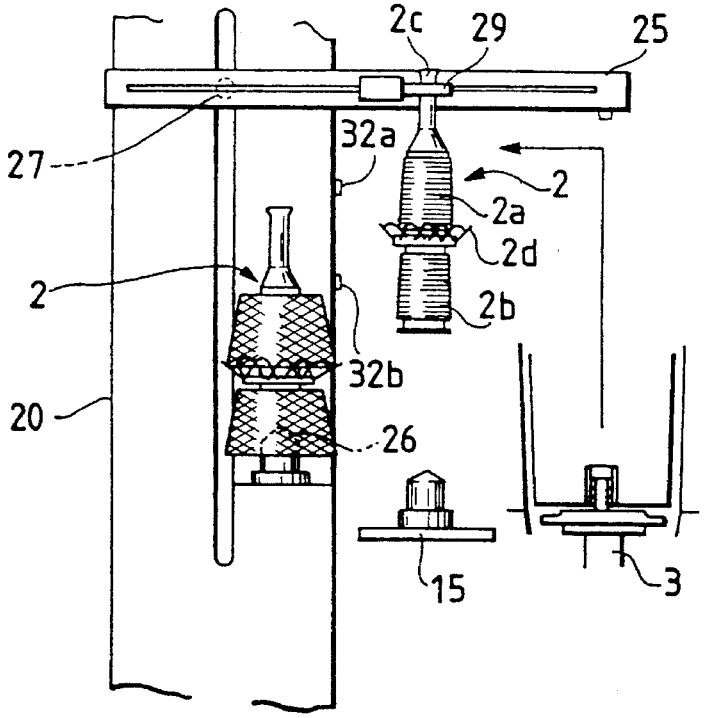
FIG. 2 is a side view of assistance in explaining a manner of detecting the exhaustion of two piled feed packages.
Figure 3:
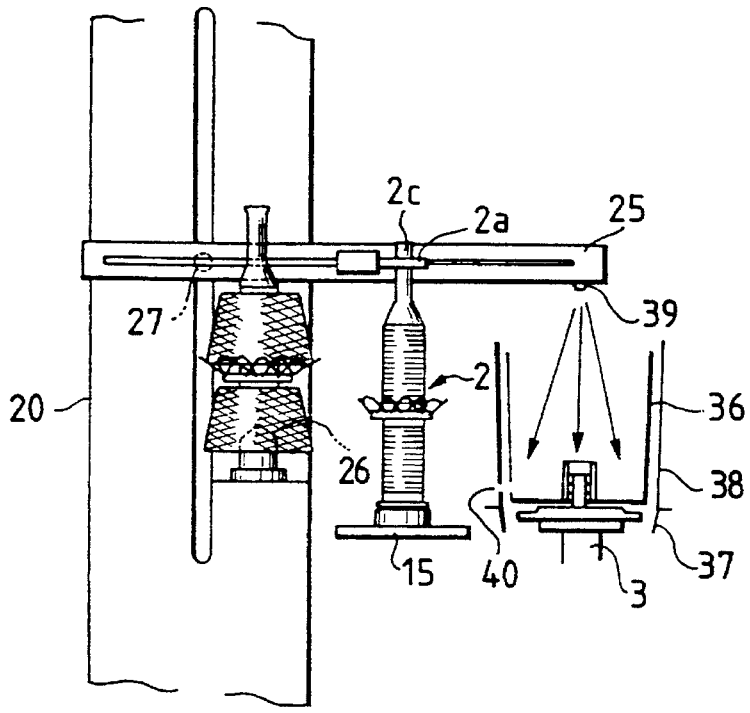
FIG. 3 is another side view of the robot device shown in FIG. 2.

The robot device 20 is provided with an operating lever 25, and a peg 26 for temporarily supporting two feed packages 2. The operating lever 25 is supported on a horizontal lifting shaft 27. A stopper 28 causes the operating lever 25 to turn counterclockwise, as viewed in FIG. 1, on the lifting shaft 27 as the lifting shaft 27 is lowered to retract the operating lever 25 into the robot device 20. When the lifting shaft 27 is raised, the operating lever 25 is allowed to turn clockwise, as viewed in FIG. 1 on the lifting shaft 27. When the lifting shaft 27 is raised beyond a level corresponding to the stopper 28, the operating lever 25 is held in a horizontal position as shown in FIG. 2. A gripper 29 for gripping the upper end of the adapter 2*c* supporting the feed packages 2 is supported for longitudinal reciprocation on the operating lever 25. A nozzle 39 for blowing compressed air to remove flies from a space in an inner cover 36 is held on the extremity of the operating lever 25 so as to be directed toward the spindle 3 as shown in FIG. 3 when the operating lever 25 is held in a horizontal position. The nozzle 39 blows compressed air after the empty feed packages 2 have been removed from the spindle 3 and the nozzle 39 has been lowered to its lowermost position as shown in FIG. 3 in transferring the empty feed packages 2 from the spindle 3 to the tray 15 during the execution of the feed package changing procedure. The nozzle 39 is connected by a supply line, not shown, to a compressed air source. A solenoid valve is provided on the supply line to control the supply of compressed air to the nozzle 39.

When it is decided that the take-up package 7 has the predetermined size, the robot device 20 depresses the pedal 19 to the first position with a pressing lever 30 to stop the spindle 3, pushes back the snail wire 8 with a pushing member, not shown, held on the front portion of the operating lever 25, pushes up the drop wire 9 so that the drop wire 9 is attracted to a magnet 31, and then operates the gripper 29 supported on the operating lever 25 for the feed package changing operation. In changing the feed package, two full feed packages 2 supported on the tray 15 placed on the feed package conveyor 16 is transferred from the tray 15 to the peg 26, the exhausted feed packages 2 are transferred from the spindle 3 to the tray 15, and then the full feed packages 2 are transferred from the peg 26 to the spindle 3. The robot device 20 is provided with two sensors 32*a* and 32*b* for detecting the exhaustion of the two feed packages 2 removed from the spindle 3 during the feed package changing operation. When the gripper 29 holding the feed packages 2 removed from the spindle 3 reaches a position above the tray 15, the feed packages 2 are disposed opposite to the detectors 32*a* and 32*b*, respectively. The leading ends of the yarns of the full feed packages 2*a* and 2*b* mounted on the tray 15 are picked up and inserted in the bore of the adapter 2*c* beforehand.

When the exhaustion of at least one of the feed packages 2*a* and 2*b* is detected during the feed package changing operation, the feed package changing operation is continued. After the feed package changing operation has been completed, the pedal 19 is depressed to the second position with the pressing lever 30 to supply compressed air to pass the leading ends of the yarns inserted in the bore of the adapter 2*c* through the bore of the spindle 3 for threading so that the leading ends of the yarns are blown upward outside the spindle 3. At the same time, the cradle 5 is expanded with an operating lever 33 to transfer the full take-up package 7 from the cradle 5 to the take-up package conveyor 17, a bobbin gripper 34 picks up one of the bobbins 4 from the bobbin stocker 18 and puts the bobbin 4 on the cradle 5 to complete the doffing operation. The operating lever 25 threads the leading ends of the yarns through the snail wire 8, the yarn guide roller 10 and the feed roller 11, and fastens the leading ends of the yarns to the bobbin 4 held on the cradle 5.

After the series of operations has been completed, the operating lever 33 lowers the cradle 5 to bring the bobbin 4 into contact with the rotary drum 6 to start winding the twisted yarn, the pressing lever 30 is retracted to release the pedal 19 so that the spindle 3 is able to rotate, the drop wire 9 is set against the twisted yarn, the operating lever 25 is retracted, and then the robot device 20 starts traveling.

On the other hand, if the sensors 32*a* and 32*b* detects that both the feed packages 2*a* and 2*b* have yarns, the robot device 20 returns the feed packages 2 onto the spindle 3, returns the full feed packages 2 supported on the peg 26 onto the tray 15, interrupts the feed package changing operation, retracts the operating lever 25, and then starts traveling. The operation of the robot 20 device is controlled by a controller included in the robot device 20.

The operation of the embodiment will be described hereinafter.

If the twisted yarn being taken up by the double-twisting unit 1 breaks, the drop wire 9 drops to turn on the switch 12 and, consequently, the cradle 5 is raised to the doffing position by the cylinder actuator 13 and the pilot lump 14 is lighted. Then, the robot device 20 traveling along the double-twisting units 1 detects the lighted pilot lamp 14 by the sensor 23 and stops at a position corresponding to the double-twisting unit 1 indicated by the lighted pilot lamp 14 and detects the size of the take-up package 7 by the sensor 24.

If the size of the take-up package 7 is smaller than the predetermined size, the robot device 20 advances without carrying out the feed package changing operation. If the size of the take-up package 7 is equal to the predetermined size, the robot starts the feed package changing operation.

First, the pressing lever 30 depresses the pedal 19 to the first position to stop the spindle 3, the lifting shaft 27 is raised to extend the operating lever 25 horizontally and the gripper 29 is moved along the operating lever 25 simultaneously, the gripper 29 transfers the full feed packages 2 from the tray 15 placed on the feed package conveyor 16 to the peg 26, and then the gripper 29 transfers the exhausted feed packages 2 from the spindle 3 to the tray 15.

After the exhausted feed packages 2 have been removed from the spindle 3, compressed air is blow from the nozzle 39 into the interior of the inner cover 36 toward the spindle 3 to blow out fly accumulated in the inner cover 36 through openings 40 formed in the inner cover 36 and an outer cover 38. Fly can effectively removed from the spindle 3 because compressed air is blown from the nozzle 39 when the spindle 3 is unloaded and the nozzle 39 is at its lowermost position, namely, at a position closest to the spindle 3.

When the exhausted feed packages 2 are positioned opposite to the sensors 32*a* and 32*b*, respectively, the sensors 32*a* and 32*b* detects the exhaustion of the feed packages 2*a* and 2*b*. If at least one of the feed packages 2*a* and 2*b* has been exhausted, the robot device 20 continues the feed package changing operation to place the feed packages 2*a* and 2*b* on the tray 15, and then transfers the full feed packages 2 from the peg 26 to the spindle 3.

After the feed package changing operation has thus been completed, the pressing lever 30 depresses the pedal 19 to the second position to blow compressed air for threading, the operating lever 33 expands the cradle 5 to deliver the full take-up package 7 to the conveyor 17, the bobbin gripper 34 takes out the bobbin 4 from the bobbin stocker 18 and puts the bobbin 4 on the cradle 5 to complete the doffing operation. The operating lever 25 passes the yarns through the snail wire 8 and fastens the leading ends of the yarns to the bobbin 4 held by the cradle 5 to complete the threading operation.

After the series of operations has been completed, the operating lever 25 of the robot device 20 lowers the cradle 5 to bring the bobbin 4 into contact with the rotary drum 6, the pressing lever 30 releases the pedal 19 to enable the spindle 3 to rotate, the drop wire 9 is set against the yarns Y, the operating lever 25 is retracted, and then the robot device 20 starts traveling again.

If the sensors 32*a* and 32*b* detect yarns on both the feed packages 2*a* and 2*b* during the feed package changing operation, the robot device 20 returns the feed packages 2 onto the spindle 3, returns the full feed packages 2 from the peg 26 to the tray 15, retracts the operating lever 25, and then starts traveling again omitting the following steps of the feed package changing operation.

The twisted yarn is broken in the double-twisting unit 1 indicated by the lighted pilot lamp 14 and for which the robot has not carried out the feed package changing operation, the operator pieces together the yarns unwound from the feed packages 2 and the twisted yarn unwound from the take-up package 7, and then starts the double-twisting and winding operation of the same double-twisting unit 1.

As is apparent from the foregoing description, according to the present device, the exhaustion of the feed packages can readily be detected because the exhaustion of the feed packages is detected during the feed package changing operation, and the feed package changing operation can efficiently be achieved because the feed package changing operation is continued if at least one of the feed packages has been exhausted, and the feed package changing operation is interrupted and the feed packages are returned onto the spindle if both the feed packages have yarns.

Figure 4:
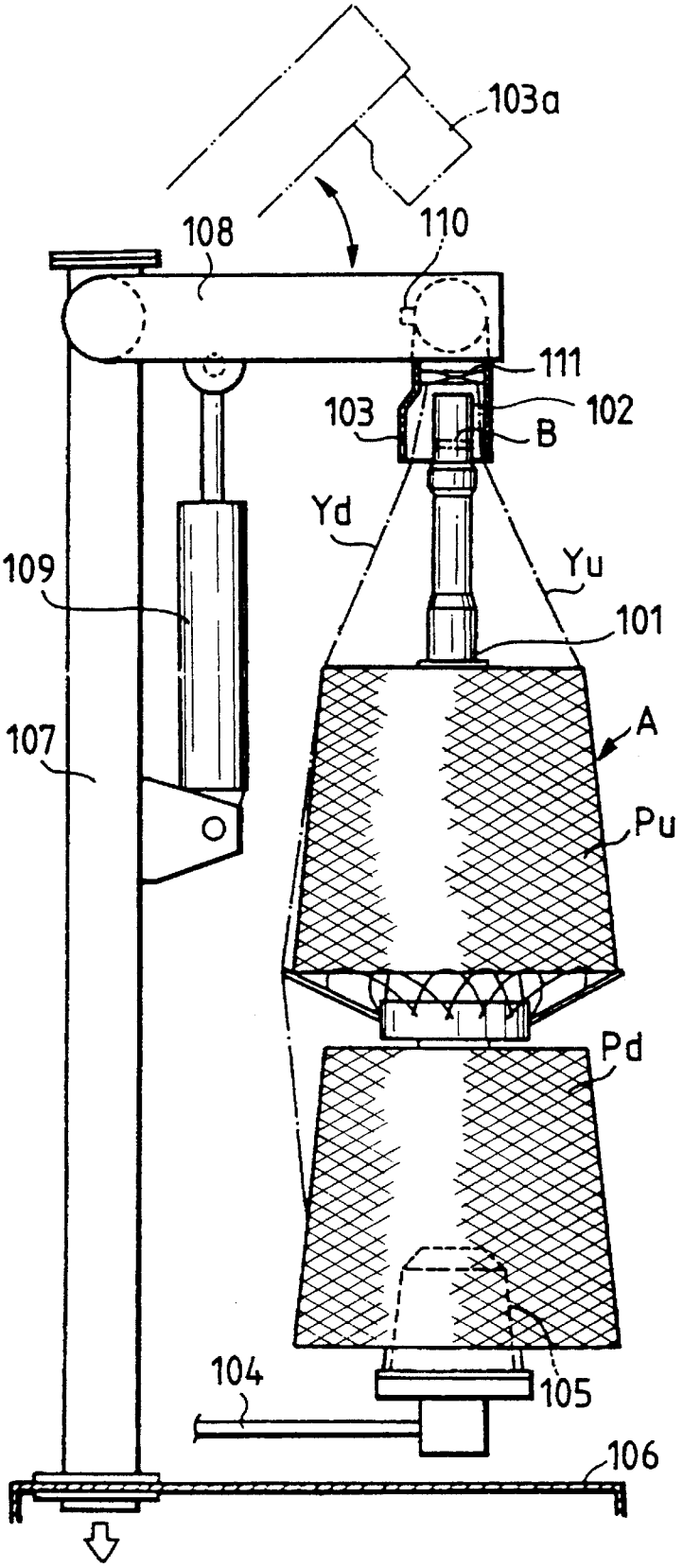
FIG. 4 is a side view showing a yarn end finding device of a robot device for a double-twister.

FIG. 4 shows the general construction of a yarn end finding device for a double-twisting robot device.

Feed packages Pu and Pd are put on an adapter 101 one over the other. The adapter 101 supporting the feed packages Pu and Pd is put on a peg 105 supported on a swing arm 104. The swing arm 104 swings to transport the adapter 101 supporting the feed packages Pu and Pd from a feed package supplying position to a yarn end finding position A shown in FIG. 4. A suction pipe 107 is set upright on a table 106 placed at the yarn end finding position A, a suction arm 108 is supported at one end for swing motion in a vertical plane on the upper end of the suction pipe 107, and a suction nozzle 103 is provided on the other end of the suction arm 108. The suction arm 108 is turned in a vertical plane by a cylinder actuator 109 supported on the suction pipe 107 between a working position indicated by continuous lines where the suction nozzle 103 is put on the top cap 102 provided on top of the adapter 101 and a standby position indicated by alternate long and short dash lines 103*a*. The feed packages Pu and Pd can be turned together with the peg 105 in a direction opposite the direction of winding of coils B of yarns wound around the top cap 102.

The suction nozzle 103 is provided with a sensor 110, such as a photoelectric sensor, for detecting yarns sucked into the suction nozzle 103, and a gripping device 111, which resembles a shutter, for closing the suction nozzle 103 and gripping the yarns upon the detection of the yarns by the sensor 110.

As soon as the feed packages Pu and Pd have been transported to the yarn end finding position A as shown in FIG. 4 by turning the swing arm 104, the suction arm 108 is turned from the position indicated by alternate long and short dash lines to the position indicated by continuous lines to put the suction nozzle 103 on the top cap 102 attached to the upper end of the adapter 101, and then the feed packages Pu and Pd are rotated. Then, the coils B wound around the top cap 102 are unwound and the yarns are sucked into the suction nozzle 103. Upon the detection of the yarns by the sensor 110, the gripping device 111 is actuated to grip the yarns, so that the yarns are not pulled any further.

In some cases, the coils B may not completely be unwound before the yarns are gripped by the gripping device 111. Therefore, a coil unwinding procedure is executed, in which the suction nozzle 103 is raised to the position indicated by the alternate long and short dash line 103*a* and, at the same time, the gripping device 111 releases the yarns, the suction nozzle 103 is put on the top cap 102 again, and then the yarns are gripped by the gripping device 111.

The yarn end finding procedure is repeated several times to unwind the coils B completely to extend the yarn ends Yu and Yd directly between the feed packages Pu and Pd, and the suction nozzle 103.

Figure 5:
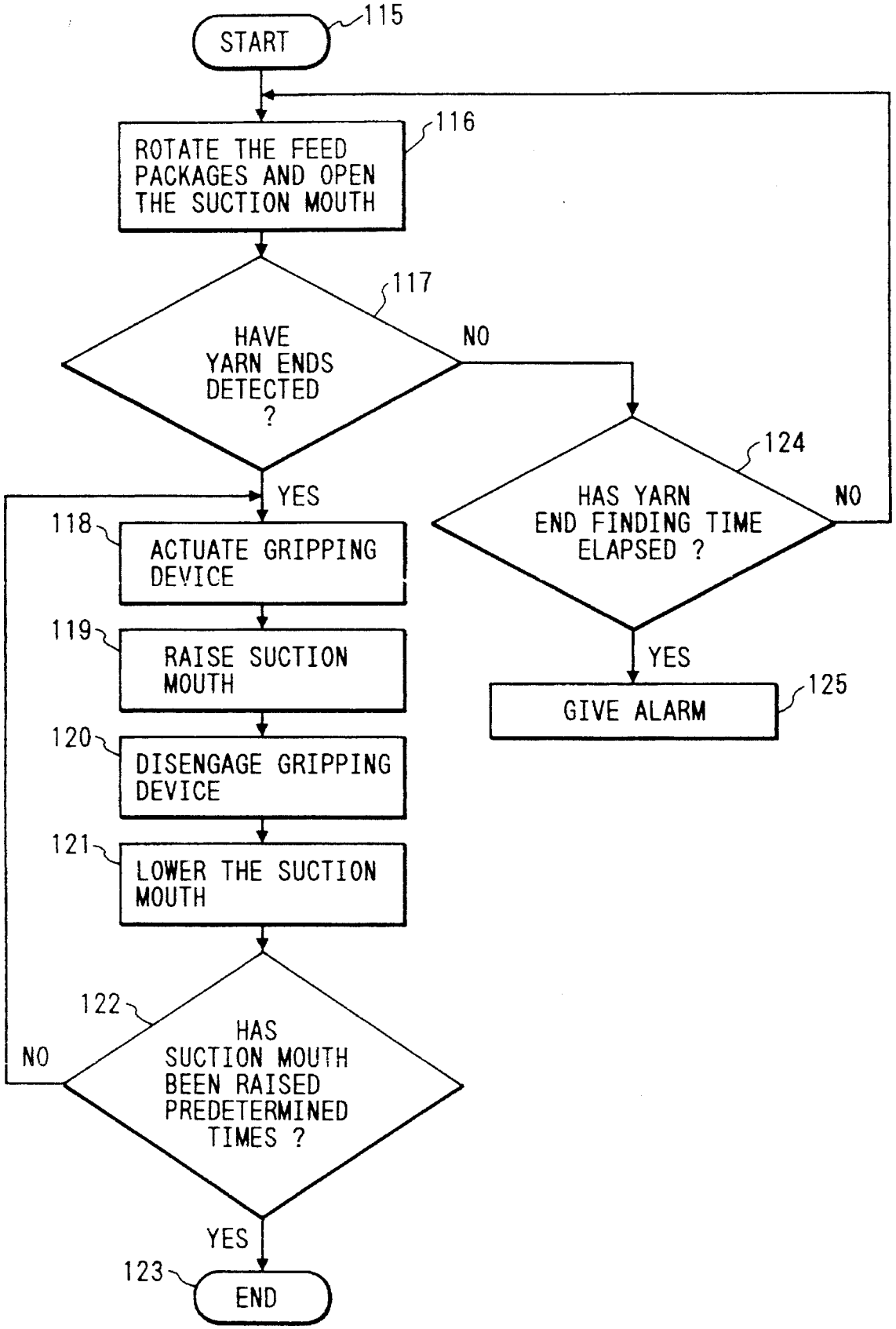
FIG. 5 is a flow chart of a yarn end finding procedure to be executed by the device shown in FIG. 4.

The foregoing yarn end finding operation will be described with reference to FIG. 5.

The yarn end finding operation is started in step 115. In step 116, the feed packages Pu and Pd are rotated, the gripping device 111 is opened and the suction nozzle starts sucking the yarn ends. In step 117, a query is made to see if the sensor 110 has detected the yarn ends. If the response in step 117 is affirmative, the gripping device 111 is actuated in step 118 to grip the yarn ends, and then the suction nozzle 103 is raised in step 119. After disengaging the gripping device 111 to release the yarn ends in step 120, the suction nozzle 103 is put on the top cap 120 again in step 121. Thus, the yarn ends pulled up as the suction nozzle 103 is raised is sucked into the suction nozzle 103, so that the coils B are unwound. A query is made in step 122 to see if the suction nozzle 103 has been raised predetermined times. If the response in step 122 is negative, the procedure returns to step 118. If the response in step 122 is affirmative, the yarn end pulling procedure is terminated. If the response in step 117 is negative, a query is made in step 124 to see if a time for yarn end pulling operation has elapsed. If the response in step 124 is affirmative, an alarm is given by appropriate means to inform the operator of failure in the yarn end finding operation in step 125.

Thus, the excessive unwinding of the yarns can be avoided by gripping the yarn ends upon the detection of the yarn ends.

After the completion of the yarn end finding operation, the feed packages Pu and Pd are transported to the double twister, not shown, the yarn ends Yu and Yd extending between the suction nozzle 103, and the feed packages Pu and Pd are cut, and then the yarn ends Yu and Yd are inserted in the bore of the adapter 101 for threading.

Although the device has been described as applied to finding the yarn ends of two feed packages supported one over the other on the adapter, the present device is applicable to finding the yarn end of a single feed package.

As is apparent from the foregoing description, the excessive unwinding of yarns from feed packages can be avoided by the cooperative operation of the sensor and the gripping device provided on the suction nozzle to grip the yarn ends upon the detection of the yarn ends by the sensor.

Figure 6:
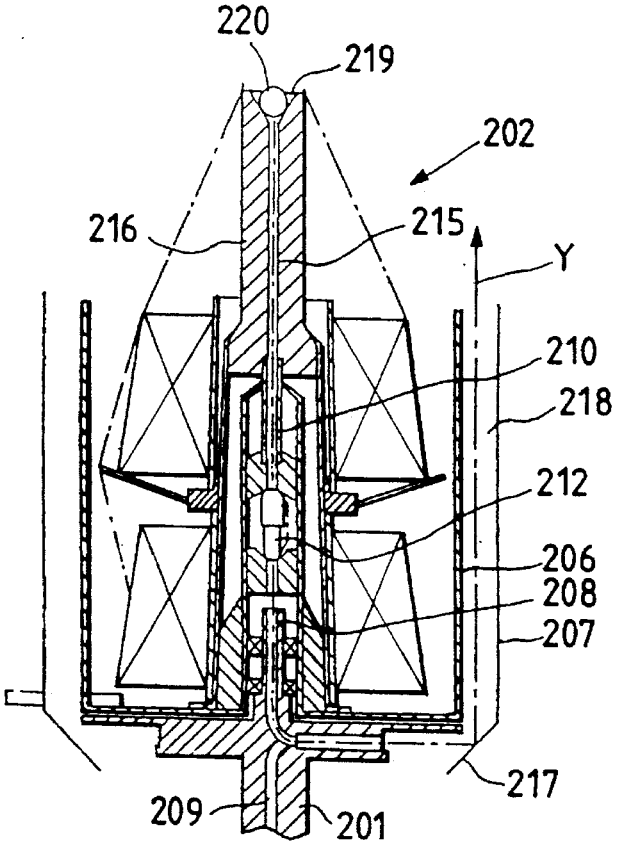
FIG. 6 is a sectional view of a double-twisting spindle unit.

Incidentally, in some spindle unit, a conical recess 219 is formed in the upper end of the top cap 216, and a steel ball 220, i.e., a tension ball, is placed in the conical recess 219 as shown in FIG. 6 to suppress tension variation and to prevent kinking while the yarns are unwound from the feed packages. In threading the yarns of the feed packages 202 through the spindle of such a construction, the steel ball 220 hinders the movement of the yarns and hence it is difficult for the conventional robot to carry out the threading operation.

Accordingly, it is another object of the present invention to provide a robot device for a double twister capable of threading yarns of feed packages supported on a spindle provided with a tension ball.

To achieve the object provides a robot device for a double twister, having an operating arm for threading the yarns of feed packages supported on a spindle of the double twister, characterized in that the operating arm is provided with a ball holding unit for attracting a steel ball mounted on the upper end of a top cap for the feed packages during threading operation.

In the threading operation, the steel ball provided on the top cap is separated from the top cap and held by the ball holding unit of the operating arm to facilitate the threading operation.

A preferred embodiment of the robot device will be described hereinafter with reference to the accompanying drawings.

Figure 7:
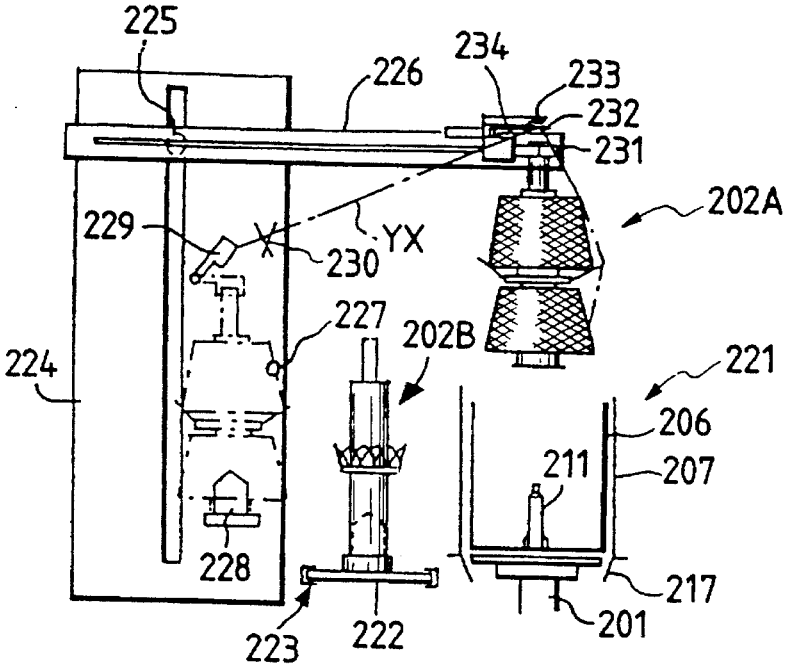
FIG. 7 is a side view of a robot device in a preferred embodiment according to the present invention for a double-twister.

Referring to FIG. 7, in which parts like or corresponding to those described with reference to FIG. 6 are denoted by the same reference characters and the description thereof will be omitted, a double twister 221 is provided with a plurality of twisting and winding units arranged in a row. Each twisting and winding unit is provided with a spindle 201 similar to the foregoing spindle 201. A conveyor 223 for conveying feed packages 202 mounted on trays 222 is in front of the twisting and winding units along the same. A robot device 224 travels along the front side of the conveyor 223.

The robot device 224 has an elongate operating arm 226 pivotally supported on a lifting shaft 225. When the lifting shaft 225 is lowered to its lowermost position, the front portion of the operating arm 226 engages a stopper 227 and the operating arm 226 is retracted into the body of the robot 224 so that the operating arm 226 may not interfere with the double twister while the robot 224 travels along the double twister. When the front portion of the operating arm 226 is not in engagement with the stopper 227, the operating arm 226 is held in a horizontal position as shown in FIG. 7 and moves vertically together with the lifting shaft 225.

The robot 224 is provided with a storage peg 228 for temporarily storing full feed packages 202A conveyed to the robot device 224 by the conveyor 223, a suction nozzle 229 for unwinding yarn ends wound around the upper end of a top cap 216 combined with the full feed packages 202A by suction, and a cutter 230 for cutting the yarn ends YX extending between the full feed packages 202A put on the spindle 201 and the suction nozzle 229 in threading the yarns of the full feed packages 202A.

Figure 8:
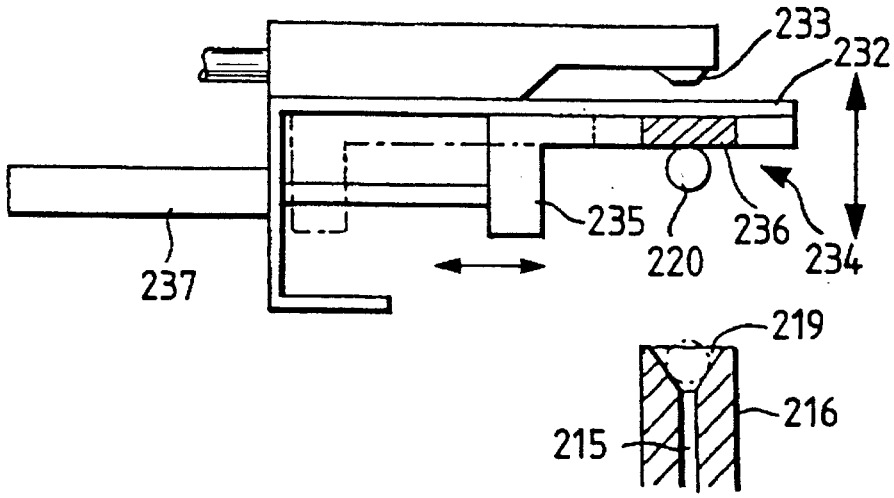
FIG. 8 is a side view of a ball holder located at the operating position.

A gripper 231 for gripping the top cap 216 combined with feed packages (either full feed packages or exhausted feed packages) is supported on the operating arm 226 for longitudinal movement along the operating arm 226. As shown in FIGS. 7 and 8, a yarn holder 232 for holding part of the yarn ends YX extended between the full feed packages 202A and the suction nozzle 229 is provided above the gripper 231. A blowing nozzle 233 for blowing compressed air into the yarn passage 215 of the top cap 216 combined with the full feed packages 202A for threading is provided above the yarn holder 232. A ball holder 234 for attracting the steel ball 220, i.e., a tension ball, placed in a recess 219 formed in the upper end of the top cap 216 is provided under the yarn holder 232.

Figure 9:
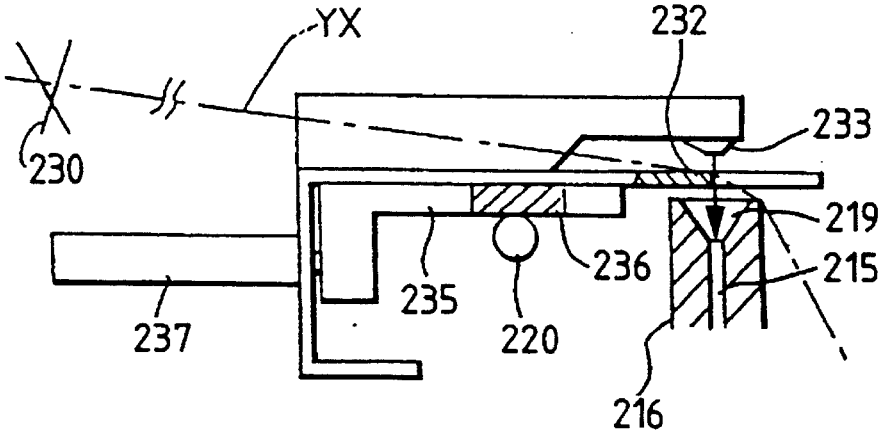
FIG. 9 is a side view of the ball holder located at the standby position during the threading operation.
Figure 10:
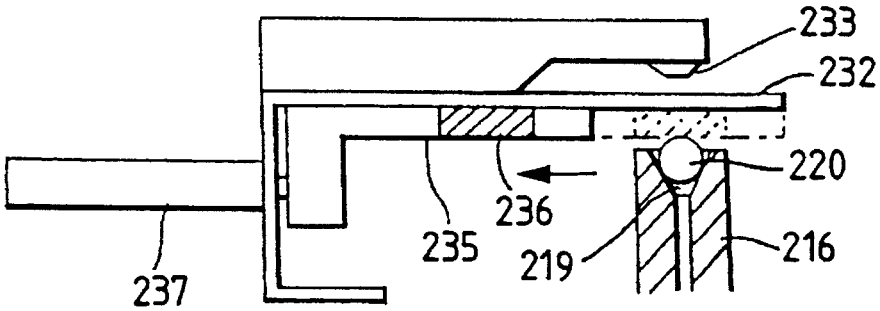
FIG. 10 is a side view of assistance in explaining an operation for returning a steel ball to a top cap.

As shown in FIGS. 8, 9 and 10, the ball holder 234 comprises a frame 235 having an L-shaped cross section, and a permanent magnet 236 attached to the frame 235. A pneumatic actuator 237 is attached to the base end of the yarn holder 232 to slide the ball holder 234 along the lower surface of the yarn holder 232. When the ball holder 234 is moved to its operating position by the pneumatic actuator 237, the permanent magnet 236 is located directly below the blowing nozzle 233 as shown in FIG. 8. When the ball holder 234 is retracted to its standby position, the permanent magnet 236 is located at a position near the base end of the yarn holder 232 and separated from the blowing nozzle 233.

The operation of the embodiment will be described hereinafter.

In threading the yarns, the full feed packages 202A are transferred from the tray 222 placed on the conveyor 223 to the storage peg 228 of the robot 224 by the combination of the vertical movement of the operating arm 226, the movement of the gripper 231 along the operating arm 226 and gripping and releasing actions of the gripper 231, and then the suction nozzle 229 unwinds the yarn ends wound around the top cap 216 combined with the full feed packages 202A supported on the storage peg 228 by suction. While the yarn ends are being unwound from the top cap 216, exhausted feed packages 202B are transferred from the spindle 201 to the tray 222 by operations similar to those for transferring the full feed packages 202A from the tray 222 to the storage peg 228.

Then, the gripper 231 is moved to put part of the yarn ends YX extending between the full feed packages 202A and the suction nozzle 229 on the yarn holder 232 and to transfer the full feed packages 202A from the storage peg 228 to the spindle 201 as shown in FIG. 7.

Then, as shown in FIG. 8, the ball holder 234 is moved to the operating position by the pneumatic actuator 234 as shown in FIG. 8, and then the operating arm 226 is lowered to locate the ball holder 234 near the top cap 216 combined with the feed packages 202 so that the steel ball 220 is attracted to the permanent magnet 236. Subsequently, the operating arm 226 is raised to remove the steel ball 220 from the recess 219 of the top cap 216, the ball holder 234 is moved to the standby position by the pneumatic actuator 237 as shown in FIG. 9, and then the operating arm 226 is lowered to locate the blowing nozzle 233 near the top cap 216. Then, compressed air is blown into the air passage 209 of the spindle 201 to generate a suction air current in the yarn passage 208, compressed air is blown from the blowing nozzle 233 into the yarn passage 215 of the top cap 216 and, at the same time, the yarn ends YX extending between the full feed packages 202A and the suction nozzle 229 is cut by the cutter 230. Consequently, the yarn ends YX are blown through the upper end of the top cap 216 into the top cap 216, pass through the yarn passages 215, 210 and 208, are deflected upward by a deflecting plate 217 and are blown upward through the space 218 between the stationary cylinder 206 and the balloon control cylinder 207 to complete threading.

After the threading operation has thus been completed, the ball holder 234 is moved to the operating position as shown in FIG. 8, the operating arm 226 is lowered to put the steel ball 220 into the recess 219 of the top cap 216, and then the ball holder 234 is returned to the standby position as shown in FIG. 10, leaving the steel ball 220 in the recess 219 of the top cap 216.

The permanent magnet 236 employed in this embodiment for holding the steel ball 220 may be substituted by a suction cup.

As is apparent from the foregoing description, according to the present device, the steel ball provided in the top cap is held by the ball holder provided on the operating arm to remove the steel ball from the top cap during the threading operation and it is therefore possible to thread the yarns of the feed packages through the spindle even if the spindle is provided with a tension ball.

Figure 11:
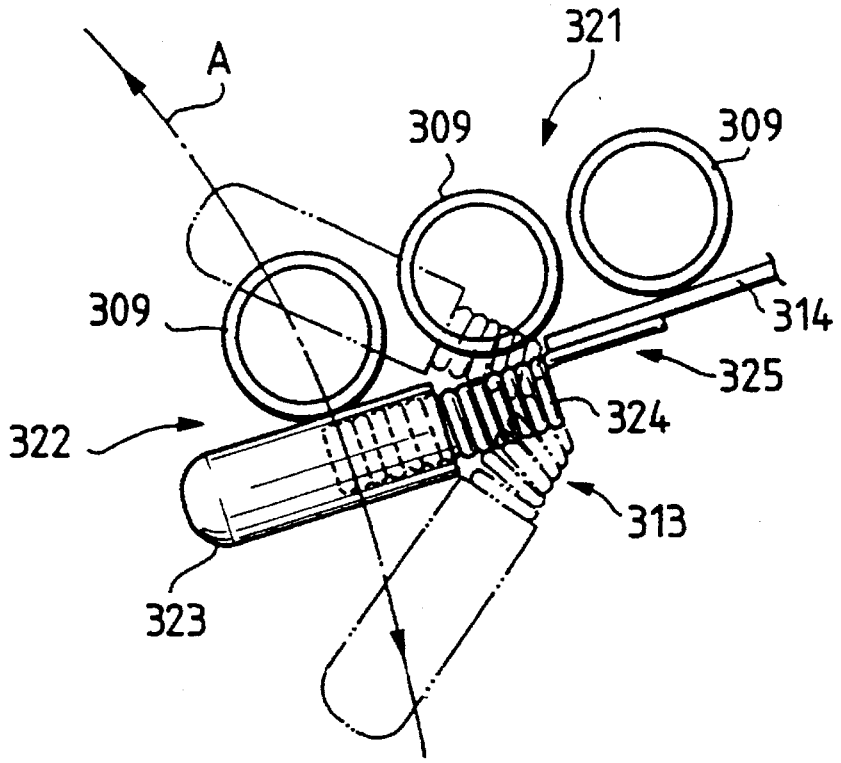
FIG. 11 is a side view showing a bobbin stocker in an embodiment according to the present invention.

FIG. 11 shows a bobbin stocker 321 in a preferred embodiment according to the present invention.

The bobbin stocker 321 has stopping members 322 for holding a bobbin 309 at a predetermined position on a bobbin extracting unit 313 and capable of bending in a vertical plane.

The stopping member 322 comprises a round bar 323, and a coil spring 324 for supporting the bar 323 on a bottom plate 314.

The bar 323 is formed of an ABS resin by molding and has a round extremity. The length of the bar 323 is far greater than the diameter of the bobbin 309. The coil spring 324 has one end attached to the lower surface of the bottom plate 314 and the other end embedded in the bar 323 by a predetermined depth.

The bar 323 is extended along the extension of the inclined bottom plate 314 to hold the bobbin 309 to be extracted so as to extend across a path A along which a gripper moves. When the gripper moving upward or downward engages the bar 323, the coil spring 324 bends resiliently on its base end 325, and the coil spring 324 restores its bobbin supporting position indicated by continuous lines in FIG. 11 after the bar 323 has been disengaged from the gripper.

Figure 12:
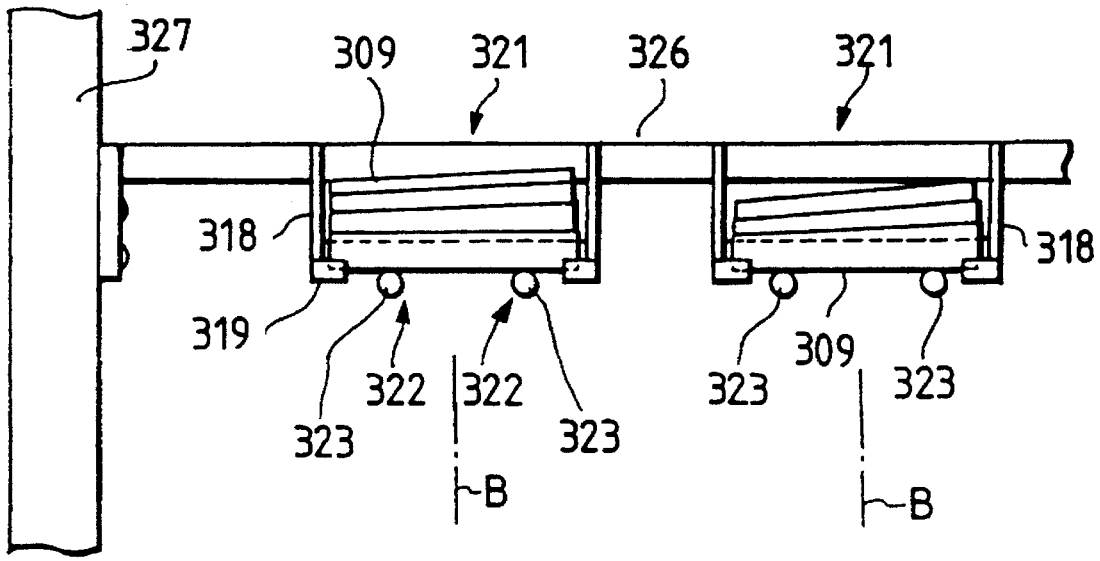
FIG. 12 is a front view of the bobbin stocker for illustrating a supporting state thereof.

In this embodiment, the bobbin stockers 321 respectively for the spindles are fixed to a longitudinal frame 326 extended along the spindles arranged in a row as shown in FIG. 12 at predetermined intervals so that the middle of each bobbin stocker 321 is located at a position corresponding to the axis B of the corresponding spindle. The opposite ends of the longitudinal frame 326 are fastened to the main frames 327 of a double twister.

The operation of the bobbin stocker in this embodiment will be described hereinafter.

Empty bobbins 309 for take-up packages are arranged on the bottom plate 314 of the bobbin stocker 321. The endmost bobbin 309 is held between the stopping members 322 of the extracting unit 313, and the free ends 319 of side plates 318.

In supplying the bobbin 309 to the double twister by the robot device, the bobbin supply arm moves downward, the gripper provided on the extremity of the bobbin supply arm grips the endmost bobbin 309 and moves to the standby position. The stopping members 322 holding the bobbin 309 are bent downward by the gripper to enable the gripper to grip the bobbin 309.

When the bobbin supply arm returns to its upper position past the bobbin stocker 321 after supplying the bobbin 309 to the cradle, in some cases, the extremity of the bobbin supply arm collides against the bars 323. In such a case, the coil springs 324 are bent to allow the bars 323 to move upward, so that shocks of collision is reduced.

Even if the bars 323 are bent upward, the bars 323 are returned to the bobbin holding position by the resilience of the coil springs 342 to hold the bobbins 309 stored on the bottom plate 314 to prepare for the next bobbin transfer operation.

Since the bars 323 are held by the coil springs 324 on the bottom plate 314 so as to be turned upward and downward, the bars 323 are able to be turned upward by the gripper when the gripper collides against the bars 323 as it moves upward, so that the bars 323 are not damaged. Since the number of the components of the stopper is less than that of the components of the conventional stopper, the stopper can be manufactured at a reduced cost and requires less work for assembly.

Since the bobbin stockers 321 for the spindles, differing from the bobbin stockers of an automatic winder, are formed in an integral unit, the respective positions of the bobbin stockers 321 need not individually be adjusted and hence the frames of the double twister can readily be assembled.

Although the stopping member 322 employed in this embodiment comprises the bar 323 and the coil spring 324, the stopping member 322 may be a single member having a high resilience attached to the bottom plate 314 (bobbin extracting unit 313).

As is apparent from the foregoing description, the device has the following excellent effects.

Since the bobbin extracting unit is provided with the stopping members capable of holding bobbins at predetermined positions and of bending upward and downward, the bobbin extracting unit is never damaged even if the bobbin supply arm or the like comes into contact therewith from under the same, components can be reduced and the cost is reduced.

Next, other embodiment of the present invention will be described hereinafter.

If the yarn is broken while the same is being taken up on a double twister, the broken yarn end is wound around the surface of the yarn layers of the take-up package. Accordingly, the broken yarn end adhering to the surface of the yarn layers of the take-up package needs to be found out to piece together the broken yarn end taken out from the take-up package and the broken yarn end taken out from the feed package.

It has been a practice that the operator finds out the broken yarn end on the take-up package, which, however, require time and labor. The winder is provided with a yarn end finding device which reverses the rotary drum, which is driven individually, of each winding unit and picks up the yarn end from the surface of a take-up package by a suction nozzle by suction. However, the technique of finding a yarn end for the winder cannot be applied without modification to a double twister because the rotary drums of the winding units of the double twister are mounted fixedly to a common drive shaft and hence the rotary drums cannot individually be reversed. Accordingly, a special driving device is necessary for driving each take-up package in a direction reverse to the winding direction, namely, in an unwinding direction, which makes the construction of the double twister complicated and increases the cost of the same.

Accordingly, this embodiment provides a yarn end finding device for a double twister, simple in construction and capable of readily finding a yarn end from the surface of a take-up package.

The present invention provides a yarn end finding device for a double twister, comprising a suction nozzle capable of being moved toward and away from a take-up package on the double twister and of exerting suction on the surface yarn layer of the take-up package, and a roller supported on the suction nozzle, capable of being inserted between the take-up package and a rotary drum for driving the take-up package, and of being driven for rotation by the rotary drum to rotate the take-up package in a direction reverse to a winding direction.

In finding the yarn end, the suction nozzle is advanced toward the take-up package so that the roller is inserted between the take-up package and the rotary drum. Then the rotation of the rotary drum is transmitted through the roller to the take-up package, so that the take-up package is rotated in a direction reverse to the winding direction, namely, an unwinding direction to facilitate finding the yarn end by the suction nozzle. Since the take-up package is driven for rotation in the unwinding direction through the roller by the rotary drum, any special driving device is unnecessary, and the yarn end finding device is simple in construction and does not entail increase in the cost.

Figure 13:
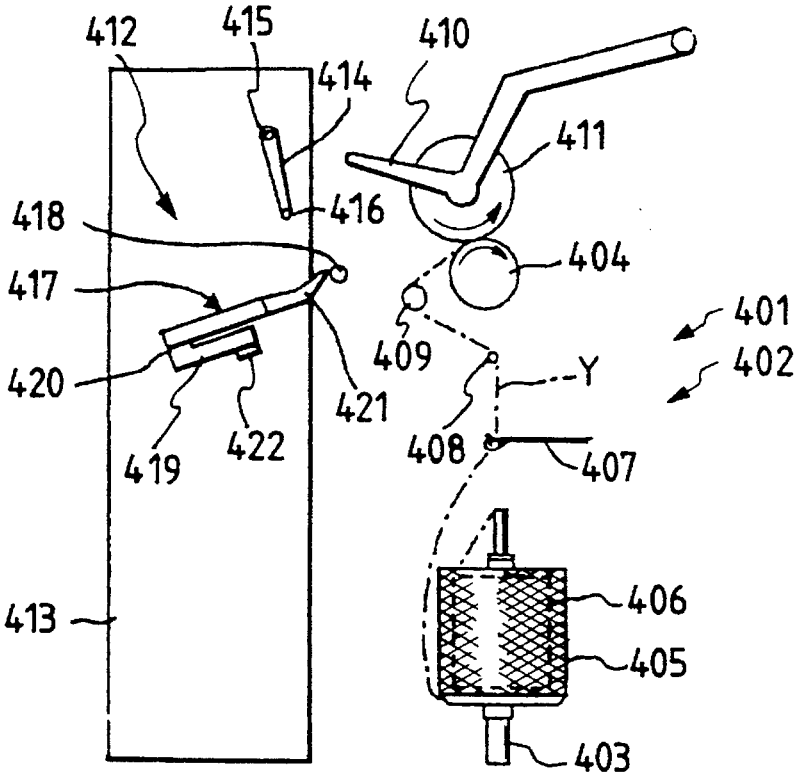
FIG. 13 is a side view of a yarn end finding device in a preferred embodiment according to the present invention.

Referring to FIG. 13, A double twister 401 has a plurality of twisting and winding units 402 arranged in a row. Each twisting and winding unit 402 has a spindle 403 disposed in a vertical position in the lower section thereof, and a rotary drum 404 disposed in a horizontal position in the upper section thereof and driven for rotation by a common drive shaft.

A feed package 406 is placed within a stationary cylinder 405 supported stationarily on the spindle 403. A yarn Y unwound form the feed package 406 is guided through the upper end of the spindle 403 into the bore of the spindle 403 and is pulled out in a radial direction from the spindle 403.

The yarn Y is twisted when the spindle 403 spins. The yarn Y form a balloon between the spindle 403 and a snail wire 407 disposed above the spindle 403. The yarn y travels upward through a guide roller 408 and a feed roller 409, and is taken-up on a take-up package 411 supported on a cradle 410, held in contact with the rotary drum 404 by gravity and driven for rotation by the rotary drum 404.

In case yarn breakage occurs in the twisting and winding unit 402 of the double twister 401, the broken yarn end on the side of the take-up package 411 is wound around the surface of the take-up package 411. In piecing together the yarn of the take-up package 411 and the yarn end of the feed package 406, a yarn end finding device 412 finds out the yarn end adhering to the surface of the take-up package 411.

Although the yarn end finding device 412 in this embodiment is incorporated into a robot device 413 for a double twister as shown in FIG. 1, each twisting and winding unit 402 may individually be provided with the yarn end finding device 412.

The robot 413 travels along the twisting and winding units 402. Upon the detection of lighted pilot lamp indicating yarn breakage, the robot 413 stops at a position corresponding to the twisting and winding unit indicated by the lighted pilot lamp. The robot 413 is provided with an operating arm for feed package changing operation. The operating arm has no direct relation with the present invention and hence the description of its construction will be omitted.

The robot 413 is provided with a cradle operating lever 414 for vertically turning, expanding and closing the cradle 410 for doffing. The cradle operating lever 414 is employed in the yarn end finding operation. The cradle operating lever 414 has one end pivotally supported on the side wall of the robot 413 and the other end provided with a projection 416 that engages the extremity of the cradle 410 from under the cradle 410.

The yarn end finding device 412 can be advanced toward and retracted away from the take-up package 411 supported by the cradle 410 on the double twister 401. The yarn end finding device 412 comprises, as principal components, a suction nozzle 417 for exerting suction on the surface of the take-up package 411, and a roller 418 supported on the suction nozzle 417 so as to be inserted between the take-up package 411 and the rotary drum 404 and to be driven for rotation by the rotary drum 404 to rotate the take-up package 411 in a direction reverse to a winding direction.

Figure 14:
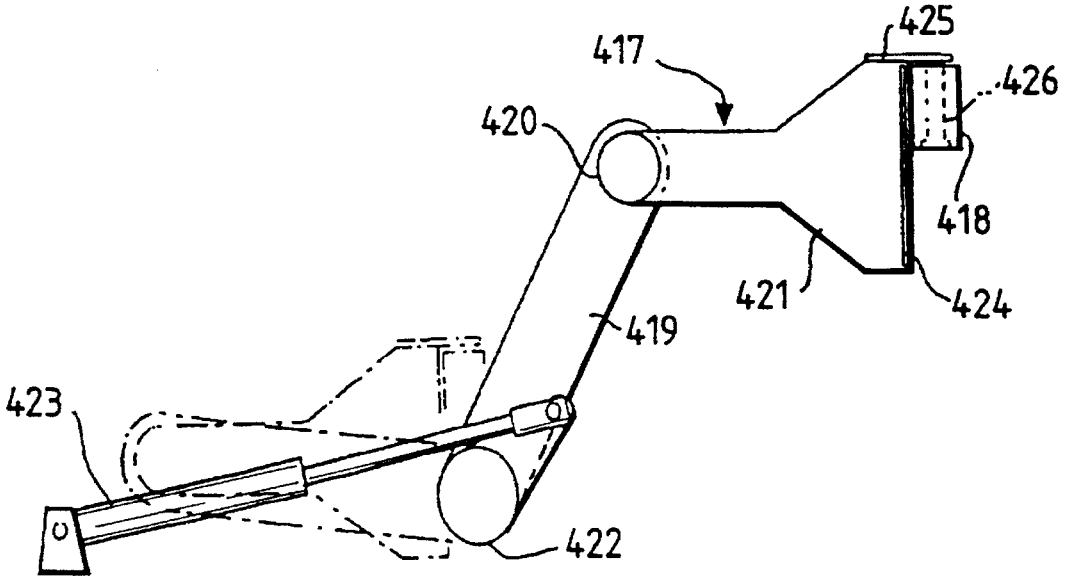
FIG. 14 is an enlarged plan view of the yarn end finding device of FIG. 13.

As shown in FIG. 14, the suction nozzle 417 comprises, as principal components, a hollow swing arm 419 pivotally supported on the robot 413, and a nozzle body 421 pivotally joined to the extremity of the swing arm 419 with a hollow joint. A hollow joint 422 connected to the base end of the swing arm 419 is connected to a vacuum source, not shown.

A pneumatic actuator 423 turns the swing arm 419 substantially in a horizontal plane between a standby position on the side of the robot 413, and an operating position near the rotary drum 404. The nozzle body 421 has a shape resembling a funnel expanding toward the free end thereof. The free end of the nozzle body 421 has a width approximately equal to the with of the yarn layer of the take-up package 411, and a suction opening 424 is formed in the free end of the nozzle body 421. In operation, the nozzle body 421 is located with its suction opening 424 under the yarn layer of the take-up package 411.

A frame 425 is attached to one side of the free end of the nozzle body 421, and a roller 418 is supported for rotation in a horizontal position on the frame 425. The nozzle body 421 is translated between the standby position and the operating position where the roller 418 is inserted between the take-up package 411 and the rotary drum 404 by a parallel motion mechanism, not shown.

The operation of the yarn end finding device will be described hereinafter.

When yarn breakage occurs in the twisting and winding unit 402 operating in a state as shown in FIG. 13, the broken end of the yarn on the side of the take-up package 411 is wound around the surface of the take-up package 411. Upon the detection of the lighted pilot lamp indicating the twisting and winding unit 402 in which yarn breakage has occurred, the robot 413 stops at a position corresponding to the same twisting and winding unit 402 to find the broken yarn end in the take-up package 411.

Figure 15:
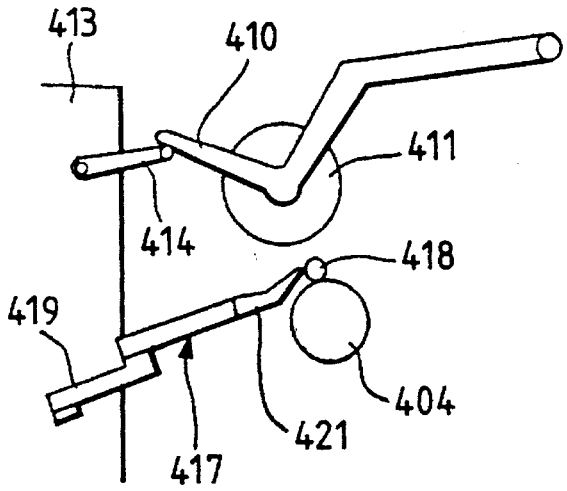
FIG. 15 is a side view of the yarn end finding device, in which a suction nozzle is advanced to an operating position.
Figure 16:
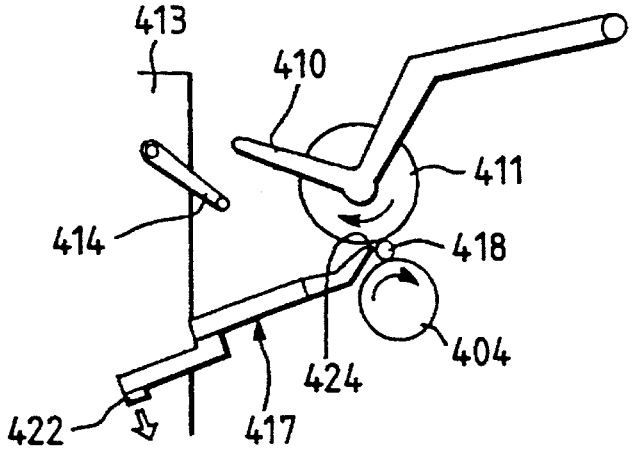
FIG. 16 is a side view of the yarn end finding device, in which a take-up package is rotated in the reverse direction and the suction nozzle is in action.

First, the cradle operating lever 414 raises the cradle 410 to separate the take-up package 411 from the rotary drum 404, and the swing arm 419 is turned to shift the suction nozzle 417 from the standby position to the operating position near the take-up package 411; consequently, the roller 418 supported on the frame 425 near the free end of the nozzle body 421 is put on the rotary drum 404 as shown in FIG. 15. Then, the cradle operating lever 414 lowers the cradle 410 to bring the take-up package 411 into contact with the roller 418 as shown in FIG. 16.

The take-up package 411 is rotated in a direction reverse to the winding direction for winding the yarn Y on the take-up package 411, namely, an unwinding direction, through the roller 418 by the rotary drum 404 and air is sucked through the suction opening 424 of the nozzle body 421 disposed near the surface of the take-up package 411, so that the broken yarn end adhering to the surface of the yarn layer of the take-up package 411 can readily be found out.

Figure 17:
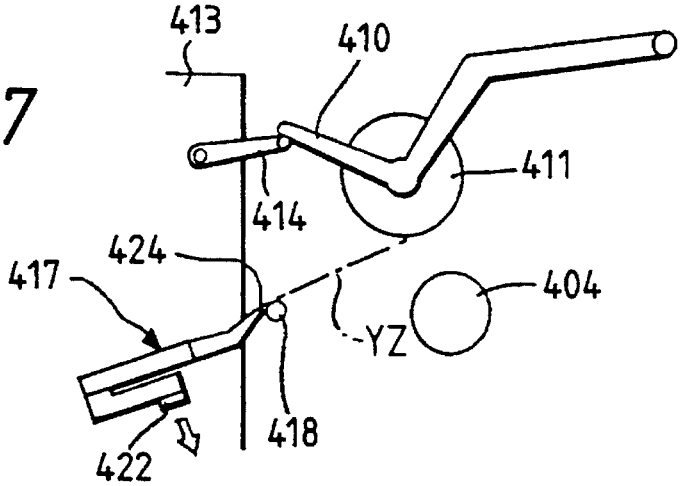
FIG. 17 is a side view of the yarn end finding device, in which the suction nozzle is returned to a standby position to complete the yarn end finding operation.

After the passage of a predetermined time or upon the detection of the broken yarn end by a sensor provided within the nozzle body 421, the cradle operating lever 414 raises the cradle 410. Then, the take-up package 411 stops naturally and the suction nozzle 417 is returned to the standby position together with the yarn end YZ as shown in FIG. 17.

Thus, the take-up package 411 can be rotated in the reverse direction by the rotary drum 404 simply by inserting the roller 418 between the rotary drum 404 and the take-up package 411, and hence any special driving device for rotating the take-up package 411 in the reverse direction is not necessary. Accordingly, the yarn end finding device is simple in construction and can be manufactured at a reduced cost. Since the take-up package 411 is put on the roller 418 provided on the free end of the nozzle body 421, the suction opening 424 can always be located at a predetermined distance from the surface of the take-up package 411 without requiring any locating mechanism regardless of the diameter of the yarn layer of the take-up package 411.

As is apparent from the foregoing description, according to this embodiment, the rotation of the rotary drum is transmitted through the roller to the take-up package to rotate the take-up package in the reverse direction, namely, the unwinding direction, to assist the suction nozzle in finding the yarn end, when the roller is inserted between the take-up package and the rotary drum by advancing the suction nozzle toward the take-up package. Accordingly, the yarn end can readily be found and pulled out from the surface of the yarn layer of the take-up package, any special driving mechanism for rotating the take-up package in the reverse direction is not necessary, and the yarn end finding device can be formed in a simple construction at a reduced cost.

What is claimed is:

1. In a piled-package type double twister having a plurality of twisting units arranged in row, each twisting unit having a spindle capable of supporting two vertically spaced feed packages, wherein yarn unwound from the feed packages and threaded through the spindle is double-twisted and taken up on a bobbin supported on a cradle to produce a take-up package, a robot device capable of traveling along the row of twisting units, the robot device comprising:

feed package changing means for removing an empty bobbin from the spindle and placing a full feed package on the spindle, doffing means for removing a full take-up package from the cradle and placing an empty bobbin on the cradle, yarn breakage detection means for detecting yarn breakage at a winding unit, means for detecting the size of the take-up package at a winding unit and for starting a feed package changing operation when the size of the take-up package exceeds a predetermined value, means for detecting the amount of yarn on each feed package during a feed package changing operation at a winding unit and for continuing the feed package changing operation if the amount of yarn on at least one of the feed packages is less than a predetermined value, and means for terminating the feed package changing operation if the amount of yarn on both feed packages is not less than a predetermined value, wherein at least one of the spindles defines an upper end in which a ball is disposed, and wherein the yarn threading means comprises an operating arm for threading yarns unwound from feed packages supported on the spindle and ball holding means for attracting the ball disposed in the upper end of the spindle.

2. In a piled-package type double twister having a plurality of twisting units arranged in row, each twisting unit having a spindle capable of supporting two vertically spaced feed packages, wherein yarn unwound from the feed packages and threaded through the spindle is double-twisted and taken up on a bobbin supported on a cradle to produce a take-up package, a robot device capable of traveling along the row of twisting units, the robot device comprising:

feed package changing means for removing an empty bobbin from the spindle and placing a full feed package on the spindle, doffing means for removing a full take-up package from the cradle and placing an empty bobbin on the cradle, yarn breakage detection means for detecting yarn breakage at a winding unit, means for detecting the size of the take-up package at a winding unit and for starting a feed package changing operation when the size of the take-up package exceeds a predetermined value, means for detecting the amount of yarn on each feed package during a feed package changing operation at a winding unit and for continuing the feed package changing operation if the amount of yarn on at least one of the feed packages is less than a predetermined value, the means for detecting the amount of yarn on each feed package comprising at least two substantially vertically aligned sensors for detecting the amount of yarn on the feed packages when the feed packages are positioned substantially opposite the sensors during the feed package changing operation, and means for terminating the feed package changing operation if the amount of yarn on both feed packages is not less than a predetermined value.

3. The device of claim 2, wherein at least two of the feed packages are supported on an adapter configured to be received by the spindle, the adapter defining an upper end, and wherein the feed package changing means comprises an operating arm, a gripper for gripping the upper end of the adapter, and a nozzle for blowing compressed air toward the spindle.

4. The device of claim 2, wherein at least two of the feed packages are supported on an adapter having a top cap around which leading yarn ends are wound, and wherein the yarn end finding device comprises:

a suction nozzle for sucking the leading yarn ends wound around the top cap, sensor means for detecting yarn sucked into the suction nozzle and generating a signal in response thereto, and a gripping device for gripping yarn sucked into the suction nozzle in response to the signal generated by the sensor means.

5. The device of claim 2, comprising a bobbin extracting unit and a bobbin stocker having a stopping member that is bendable in a substantially vertical plane for holding an empty bobbin at a predetermined position relative to the doffing means.

6. In a piled-package type double twister having a plurality of twisting units arranged in row, each twisting unit having a spindle capable of supporting two vertically spaced feed packages, wherein yarn unwound from the feed packages and threaded through the spindle is double-twisted and taken up on a bobbin supported on a cradle to produce a take-up package, a robot device capable of traveling along the row of twisting units, the robot device comprising:

feed package changing means for removing an empty bobbin from the spindle and placing a full feed package on the spindle, yarn end finding means for finding a yarn end on a full feed package, doffing means for removing a full take-up package from the cradle and placing an empty bobbin on the cradle, yarn breakage detection means for detecting yarn breakage at a winding unit, means for detecting the size of the take-up package at a winding unit and for starting a feed package changing operation when the size of the take-up package exceeds a predetermined value, means for detecting the amount of yarn on each feed package during a feed package changing operation at a winding unit and for continuing the feed package changing operation if the amount of yarn on at least one of the feed packages is less than a predetermined value, and means for terminating the feed package changing operation if the amount of yarn on both feed packages is not less than a predetermined value, wherein the take-up package defines a surface, wherein at least one of the twisting units includes a rotary drum for driving the take-up package in a winding direction, and wherein the yarn end finding means comprises:

a suction nozzle that is moveable relative to the take-up package for exerting a suction force on the surface of the take-up package, and a roller supported on the suction nozzle for insertion between the take-up package and the rotary drum, the roller inserted between the take-up package and the rotary drum being rotatable by the rotary drum to thereby rotate the take-up package in a direction opposite to the winding direction.

7. In a piled-package type double twister having a plurality of twisting units arranged in row, each twisting unit having a spindle capable of supporting two vertically spaced feed packages, wherein yarn unwound from the feed packages and threaded through the spindle is double-twisted and taken up on a bobbin supported on a cradle to produce a take-up package, a method comprising the steps of:

providing a robot device capable of traveling along the row of twisting units, the robot device comprising feed package changing means for removing an empty bobbin from the spindle and placing a full feed package on the spindle, and doffing means for removing a full take-up package from the cradle and placing an empty bobbin on the cradle, detecting yarn breakage at a winding unit, moving the robot to the winding unit at which yarn breakage is detected, detecting the size of the take-up package at a winding unit, starting a feed package changing operation when the size of the take-up package exceeds a predetermined value, detecting the amount of yarn on each feed package at the winding unit, wherein the step of detecting the amount of yarn on each feed package comprises providing at least two substantially vertically aligned sensors for detecting the amount of yarn on the feed packages when the feed packages are positioned substantially opposite the sensors during the feed package changing operation, continuing the feed package changing operation if the amount of yarn on at least one of the feed packages is less than a predetermined value, and terminating the feed package changing operation if the amount of yarn on both feed packages is not less than a predetermined value.

* * * * *